United States Patent [19]

Schwede

[11] 3,946,906

[45] Mar. 30, 1976

[54] NOZZLE FOR PRESSURIZED CANS OF WHIPPED TOPPING

[76] Inventor: William Schwede, 40 Woodmar Terrace, West Seneca, N.Y. 14224

[22] Filed: July 7, 1975

[21] Appl. No.: 593,539

[52] U.S. Cl. ..... 222/135; 222/94; 426/249

[51] Int. Cl.[2] ..... B67D 35/22

[58] Field of Search ..... 222/106, 94, 133, 135, 222/145; 426/249; 239/304

[56] References Cited

UNITED STATES PATENTS 3,110,423 11/1963 Hegedic et al. ..... 222/135

3,174,691 3/1965 Haviland ..... 222/133 X

*Primary Examiner*—Allen N. Knowles
*Assistant Examiner*—Hadd S. Lane
*Attorney, Agent, or Firm*—Bean & Bean

[57] ABSTRACT

A nozzle for a pressurized can of whipped topping is constructed to facilitate attachment of a color dispenser characterized as including a source of coloring matter and a distributor ring having a plurality of nozzles spaced apart about its inner circumference and arranged in flow communication with the source.

11 Claims, 5 Drawing Figures

NOZZLE FOR PRESSURIZED CANS OF WHIPPED TOPPING

BACKGROUND OF THE INVENTION

In my copending patent application Ser. No. 474,720, filed May 30, 1974, now U.S. Pat. No. 3,896,971 of July 29, 1975, there is disclosed a color dispenser including a source of coloring matter in the form of a flexible pouch and a hollow distributor ring, which is formed with a plurality of discharge nozzles arranged about its inner circumference and arranged in flow communication with the source. In use, the distributor ring is slipped over the nozzle of a conventional pressurized can of whipped topping, and when finger pressure is applied to the pouch, coloring matter is squeezed out through the discharge nozzles and through slits of the can nozzle for mixing with the whipped topping flowing therefrom.

SUMMARY OF THE INVENTION

The present invention is directed towards improvements in the construction of a nozzle of a pressurized can of whipped topping, which facilitates attachment of a color dispenser of the general type disclosed in my copending patent application Ser. No. 474,720, filed May 30, 1974, now U.S. Pat. No. 3,896,971 of July 29, 1975.

More particularly, the improved can nozzle construction of the present invention features the provision of apertures adapted to positionally locate the nozzles of a distributor ring in flow communication with a whipped topping discharge passageway extending through the can nozzle, while insuring against uncontrolled loss or escape of the topping or coloring matter.

A sealing ring may be removably fitted about the nozzle to prevent escape of topping outwardly through the apertures when it is desired to perform a topping dispensing operation with the color dispenser removed from the nozzle.

DRAWINGS

The nature and mode of operation of the present invention is now more fully described in the following detailed description taken with the accompanying drawings wherein:

FIG. 1 is an exploded perspective view illustrating a nozzle formed in accordance with the present invention with associated, removable attached color dispenser and sealing devices;

FIG. 2*a* is a fragmentary view taken through the nozzle with color dispenser attached thereto;

FIG. 2*b* is a fragmentary sectional view taken through the nozzle with a sealing device attached thereto;

FIG. 3 is an elevational view illustrating an alternative nozzle construction; and FIG. 4 is a view similar to FIG. 2*a*, but showing the color dispenser associated with the alternative nozzle construction.

DETAILED DESCRIPTION

Figure 1:
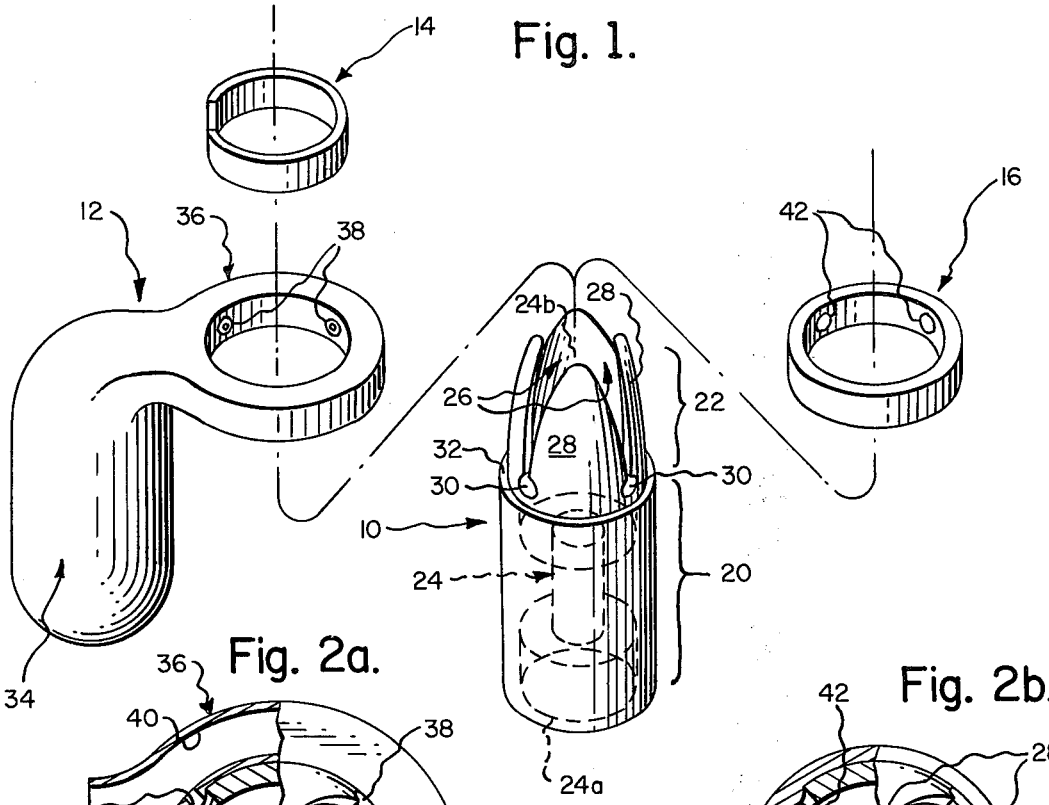

Reference is now made particularly to FIG. 1, wherein a nozzle formed in accordance with the present invention is generally designated as 10 and shown in association with a removably attached color dispenser 12 provided with a removably attached sealing device 14 and a removably attached nozzle sealing device 16.

Nozzle 10 may be structurally similar to that described in U.S. Pat. No. 3,722,760 and my copending application Ser. No. 474,720 from the standpoint that it comprises an elongated body formed of a plastic material and characterized as including a generally cylindrical base portion 20 and an integrally formed generally frusto-conically shaped discharge portion 22. A passageway 24, which is arranged to extend axially through the body of nozzle 10, is provided with an inlet end 24*a* defined by base portion 20 and a discharge orifice 24*b* defined by discharge portion 22. Inlet end 24*a* may be variously configurated, as required to permit attachment of nozzle 10 in flow communication with the discharge of a conventional pressurized can, not shown, containing whipped topping or other material to which coloring matter may be added by operation of color dispenser 12, as will hereinafter be described. As is conventional, tilting of nozzle 10 relative to the can will immediately result in topping being released from the can for flow outwardly through passageway 24.

In the preferred form of the present invention, discharge portion 22 is formed with a plurality of slits 26 radiating from orifice 24*b*, so as to define a plurality of resiliently deformable fingers 28 spaced circumferentially of the nozzle body; a plurality of apertures 30 are formed as enlargements of the closed ends of slits 26 and open in radial flow communication with passageway 24; and base portion 20 is enlarged to define an annular abutment surface 32, which extends radially of discharge portion 22 and faces axially towards orifice 24*b*.

Figure 2A:
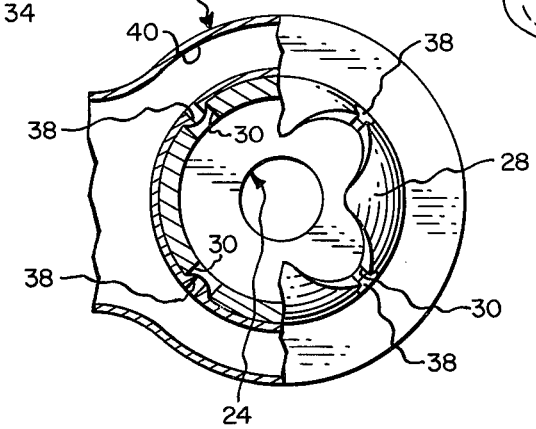
Figure 4:
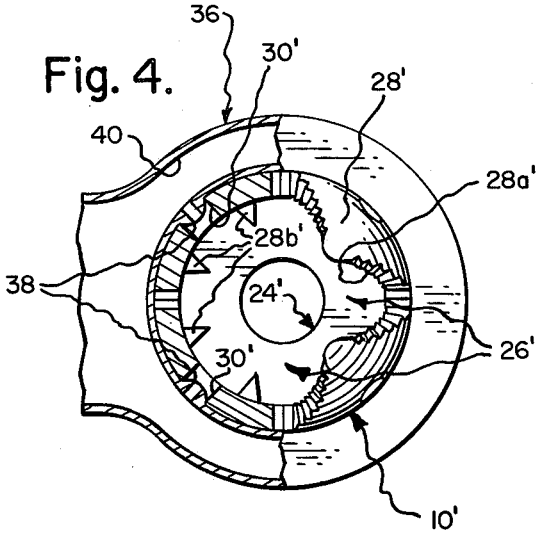

Color dispenser 12 generally includes a source of coloring matter, such as may be defined by a flexible hollow pouch 34; and a distributor ring 36, which has a plurality of small, rounded nozzles 38 spaced about its inner circumference or central opening and arranged in flow communication with pouch 34 via passageway 40 in the manner shown in FIGS. 2*a* and 4. When color dispenser 12 is not in use, unintended escape of coloring matter through nozzles 38 may be prevented by inserting sealing device 14 within the central opening of distributor ring 36. Device 14 is preferably of a generally C-shaped design and formed of a resiliently deformable material to facilitate its being removably attached to the distributor ring.

By viewing FIGS. 1 and 2*a*, it will be understood that apertures 30 are arranged and dimensioned to snap-fit receive nozzles 38, as distributor ring 36 is moved axially over discharge portion 22 towards base portion 20, whereby to removably retain color distributor 12 in operative association with nozzle 10 and to fluid seal nozzles 38 relative to the portions of the discharge portion bounding apertures 30 in order to prevent escape of topping and/or coloring matter outwardly through such apertures.

In operation, when finger pressure is applied to pouch 34, nozzle 10 is tilted or displaced from its normal position relative to the can, whereby to effect discharge of topping outwardly through passageway 24 while coloring matter is forced through nozzles 38 into such passageway for mixing with and effecting coloring of the topping.

The spacing of surface 32 from apertures 30 serves to prevent movement of distributor ring 36 over discharge portion 22 beyond a position in which nozzles 38 are aligned with apertures 30. This both facilitates attachment and insures that nozzles 38 do not become "wedged" against the outer surface of base portion 20, such as would render difficult subsequent removal of color distributor 12.

The snap fitting of nozzles 38 within apertures 30 is made possible in accordance with the preferred form of the present invention by the resiliently deformable design of fingers 28, at least adjacent slits 26 and apertures 30, and the illustrated rounded shape of nozzles 38. Preferably, distributor ring 36 would also be formed of a resiliently deformable material in order to permit slight deformation of the individual nozzles, as the distributor ring is forced over discharge portion 22. Attachment may also be facilitated by slightly enlarging the diameter of the central opening of distributor ring 36 over that shown in FIG. 2*a*, so as to provide for a small radial clearance or spacing between the distributor ring and the base of discharge portion 22.

Further, it is anticipated that passageway 40 will be blocked or discontinuous at a point circumferentially remote from pouch 34 in order to minimize the amount of "wasted" coloring matter remaining in distributor ring 36 after complete discharge of coloring matter from the pouch. In such case, distributor ring 36 may be of a C-shape plan view configuration in order to facilitate removable snap-fitting association of nozzles 38 with apertures 30.

Figure 2B:
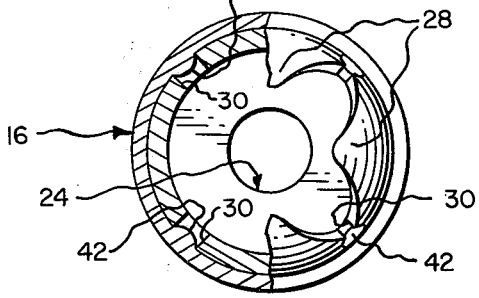

When a user desires to dispense topping without the addition of coloring material, color distributor 12 would first be removed and the sealing device 16 forced onto discharge portion 22 in order to snap-fit its "false nozzle" projections 42 into apertures 30 in the manner indicated in FIG. 2*b*. Preferably, sealing device 16 would be axially sized to engage surface 32 when projections 42 are brought into alignment with apertures 30. Sealing device 16 may be of a ring or C-shaped configuration, as desired.

Figure 3:
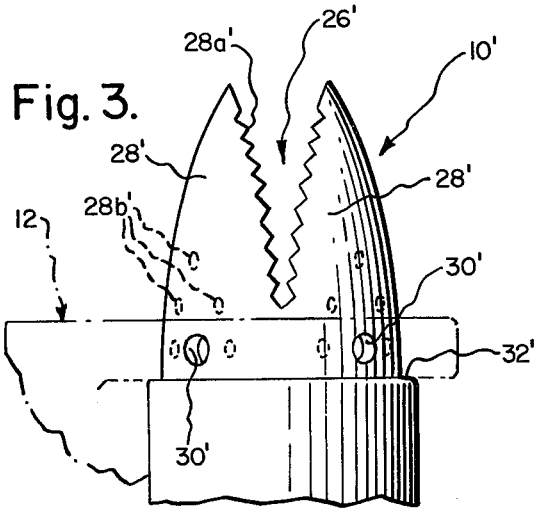

An alternative construction of the nozzle of the present invention is generally designated as 10' in FIGS. 3 and 4. This construction departs from that previously described in that apertures 30' are arranged to pass one through the base of each of fingers 28' such that they are disposed circumferentially intermediate slits 26'; the slit bounding edges 28*a'* of fingers 28' are serrated; and fingers 28' are provided with integrally formed elements 28*b'*, which project radially into passageway 24'. The positioning of apertures 30' and the provision of elements 28*b'* allows coloring matter injection/turbulent flow coloring matter-topping mixing conditions to occur substantially upstream of the point of discharge of the topping from nozzle 10. Mixing is further enhanced or rendered more uniform by the "raking" action of serrated edges 28*a'* on the mixture of coloring matter and topping, as it flows through orifice 24*b*.

The present invention is primarily intended to facilitate the selective introduction of food coloring matter into customarily white, edible whipped topping in order to improve the appearance of or create decorative effects on foods, such as cakes, pies and other desserts, to which topping is applied. However, it will be understood that the present invention may be used to color or tint non-food products dispensed from pressurized cans, e.g. shaving cream or similar thick foam products, which may be used for decorative purposes. Thus, the term "whipped topping", as used herein, is intended to be generic and refer to both food and non-food products dispensed as a thick foam from pressurized cans.

I claim:

1. In a nozzle of the type adapted to be fitted to a pressurized can of whipped topping, the improvement in nozzle construction facilitating attachment to the nozzle of a color dispenser characterized as including a source of coloring matter and a distributor ring having a plurality of nozzles spaced about its inner circumference and arranged in flow communication with said source, said nozzle construction comprising:

an elongated body formed of plastic material and characterized as including a generally cylindrical base portion and an integrally formed generally frusto-conically shaped and resiliently deformable discharge portion, said body having an axially extending through passageway provided with an inlet end defined by said base portion for fitting said nozzle construction to said can and with a discharge orifice defined by said discharge portion, and a plurality of apertures arranged within said discharge portion adjacent the juncture thereof with said base portion, said apertures extending radially through said discharge portion and opening in flow communication with said passageway, and said apertures being arranged and dimensioned to snap-fit receive said nozzles of said ring as said ring is moved axially over said discharge portion towards said base portion, whereby to removably retain said color distributor in operative association with said nozzle construction with the periphery of said nozzles of said ring fluid sealed relative to portions of said discharge portion bounding said apertures to prevent escape of topping outwardly through said apertures; and sealing means detachably secured about said nozzle construction for closing said apertures when said color dispenser is removed from said nozzle construction.

2. A nozzle construction according to claim 1, wherein said discharge portion is formed with a plurality of slits radiating from said discharge orifice and having closed ends disposed adjacent the juncture of said discharge portion with said base portion, whereby to define a plurality of fingers spaced circumferentially of said body, and said apertures are formed as enlargements of said closed ends of said slits.

3. A nozzle construction according to claim 1, wherein said discharge portion is formed with a plurality of slits radiating from said discharge orifice and having closed ends disposed adjacent the juncture of said discharge portion with said base portion, whereby to define a plurality of fingers spaced circumferentially of said body, and said apertures are formed in said fingers circumferentially intermediate said slits.

4. A nozzle construction according to claim 3, wherein edges of said fingers bounding said slits are serrated.

5. A nozzle construction according to claim 3, wherein said fingers are provided with integrally formed elements projecting radially into said passageway, said elements being arranged to create turbulent flow conditions within said passageway adjacent said apertures.

6. A nozzle construction according to claim 5, wherein edges of said fingers bounding said slits are serrated.

7. A nozzle construction according to claim 1, wherein said sealing means is a loop dimensioned to encircle said discharge portion adjacent the juncture thereof with said base portion and formed with false nozzle projections spaced about its inner circumference, said projections being arranged and dimensioned to be removably snap-fit received within said apertures in topping escape sealing engagement with portions of said discharge portion bounding said apertures.

8. A nozzle construction according to claim 1, wherein said base portion has an external diameter exceeding that of said discharge portion at least adjacent said juncture, whereby to define an annular abutment surface extending radially of said discharge portion and facing axially towards said discharge orifice, said abutment surface being radially sized and spaced from said apertures to prevent movement of said ring over said discharge portion beyond a position in which said nozzles of said ring are aligned with said apertures.

9. In a dispensing apparatus including a nozzle adapted to be fitted to a pressurized can of whipped topping and a color dispenser adapted to be removably attached to said nozzle for introducing coloring matter into said whipped topping while passing through said nozzle, the improvement facilitating attachment of said color dispenser to said nozzle wherein said color dispenser is characterized as comprising a source of coloring matter and a distributor ring having a plurality of nozzles spaced about its inner circumference and arranged in flow communication with said source, said nozzle is characterized as comprising an elongated body including a generally cylindrical base portion and an integrally formed generally frusto-conically shaped discharge portion, said body having an axially extending through passageway provided with an inlet end defined by said base portion for fitting said nozzle to said can and with a discharge orifice defined by said discharge portion, and a plurality of apertures arranged within said discharge portion adjacent the juncture thereof with said base portion, said apertures extending radially through said discharge portion and opening in flow communication with said passageway, and said apertures being arranged and dimensioned and at least one of said distributor ring and said discharge portion being formed of resiliently deformable plastic material whereby to permit snap-fitting of said nozzles of said ring within said apertures as said ring is moved axially over said discharge portion towards said base portion in order to removably attach said color distributor in operative association with said nozzle with the periphery of said nozzles of said ring fluid sealed relative to portions of said discharge portion bounding said apertures to prevent escape of said whipped topping forwardly through said apertures, and there is further provided in combination sealing means detachably secured about said nozzle for closing said apertures when said color dispenser is removed from said nozzle.

10. An apparatus according to claim 9, wherein said discharge portion is formed with a plurality of slits radiating from said discharge orifice and having closed ends disposed adjacent the juncture of said discharge portion with said base portion, whereby to define a plurality of fingers spaced circumferentially of said body, said apertures are formed as enlargements of said closed ends of said slits, and said discharge portion is formed of resiliently deformable material.

11. An apparatus according to claim 9, wherein said discharge portion is formed with a plurality of slits radiating from said discharge orifice and having closed ends disposed adjacent the juncture of said discharge portion with said base portion, whereby to define a plurality of fingers spaced circumferentially of said body, said apertures are formed in said fingers circumferentially intermediate said slits, and both said distributor ring and said discharge portion are formed of resiliently deformable material.

* * * * *